United States Patent [19]

Fussell

[11] Patent Number: 4,621,984

[45] Date of Patent: Nov. 11, 1986

[54] PORTABLE AIR PUMP

[75] Inventor: David A. Fussell, Lawrenceville, Ga.

[73] Assignee: Air Shot, Inc., Norcross, Ga.

[21] Appl. No.: 724,293

[22] Filed: Apr. 17, 1985

[51] Int. Cl.[4] ..... F04B 35/04

[52] U.S. Cl. ..... 417/234; 417/411

[58] Field of Search ..... 417/234, 411; 141/38; 128/204.16, 204.18

[56] References Cited

U.S. PATENT DOCUMENTS

| | | | |
|---|---|---|---|
| 1,647,818 | 11/1927 | Semak | 417/411 |
| 3,243,100 | 3/1966 | Adams | 417/411 X |
| 3,646,934 | 3/1972 | Foster | 128/204.16 |
| 3,776,666 | 12/1973 | Ludwig | 417/411 |
| 4,004,862 | 1/1977 | Hill | 417/411 |
| 4,021,150 | 5/1977 | Mabuchi | 417/411 |
| 4,080,103 | 3/1978 | Bird | 128/204.16 X |
| 4,135,647 | 1/1979 | Mascia et al. | 417/411 X |
| 4,331,883 | 5/1982 | Vitaloni | 417/411 |
| 4,375,162 | 3/1985 | Eppley | 417/411 X |

FOREIGN PATENT DOCUMENTS

| | | | |
|---|---|---|---|
| 2701556 | 7/1978 | Fed. Rep. of Germany | 417/411 |

*Primary Examiner*—Carlton R. Croyle
*Assistant Examiner*—Theodore W. Olds
*Attorney, Agent, or Firm*—Thomas & Kennedy

[57] ABSTRACT

A portable air pump has a housing formed with internal walls that partition two compartments, one of which is accessible from ambience through a door. A flexible air hose is compactly stowed in the accessible compartment and connected with an air compressor housed in the other compartment for extension to ambience. A recharger with flexible wiring is also stowed within the accessible compartment adjacent the flexible air hose.

2 Claims, 5 Drawing Figures

PORTABLE AIR PUMP

TECHNICAL FIELD

This invention relates to portable air pumps.

BACKGROUND OF THE INVENTION

Air pumps are today commonly used to inflate vehicle wheel tires as well as for various other purposes. They are usually located at vehicle service stations in permanent locations where they are accessible to vehicles being driven upon public roads. There are today, however, sports events, particularly automobile and bicycle races, that are conducted off of public roads where the participants do not have ready access to such air pumps. As a result, semi-portable air pumps have been developed for use away from public roads and services stations.

Portable, or more correctly termed semi-portable, air pumps have conventionally included a compressor to which an electrical cord is connected for coupling engagement with a cigarette lighter socket located within an automobile or truck cabin. When the need arises in a sporting event, as when a tire becomes deflated and requires reinflation, a cyclist may push or cycle his disabled bicycle over to the same automobile or truck that brought the cyclist and bicycle to the event and there use the air pump powered by the transporting and support vehicle itself to inflate the tire. Though this type of semi-portable air pump has served its purpose, its use has nevertheless required the consumption of valuable racing time in bringing a disabled bicycle to and from the bicycle transport and support vehicle.

Accordingly, it is a general object of the present invention to provide a portable air pump that overcomes the just described problems by having a self contained power supply that renders the pump truely portable.

Another object of the invention is to provide a portable air pump having a highly compacted light weight configuration.

Another object of the invention is to provide a portable air pump having a battery type power supply together with means for readily charging the battery that may be stowed efficiently and in a compacted configuration within the pump itself.

SUMMARY OF THE INVENTION

In one form of the invention, a portable air pump comprises a housing having an internal wall that partitions first and second compartments. An air compressor is mounted within the first compartment and a battery is also mounted within the first compartment and electrically coupled with the air compressor through a switch. A door is mounted to the housing for providing access from ambience to the interior of the second compartment. A flexible air hose is housed within the second compartment for extension to ambience through the door and connected with the air compressor through an opening in the internal wall.

In another form of the invention a portable air pump comprises a housing and a partition that partitions first and second internal compartments. A battery is mounted within the first compartment adjacent the housing floor and coupled with a jack mounted on the housing. An air compressor is mounted within the first compartment adjacent the battery and electrically coupled with the battery through a switch mounted on the housing. Door means provide access from ambience into the interior of the second compartment. A battery recharger is removably stowed within the second compartment which has flexible wiring that terminates in a plug adapted for releasible connection with the jack. An air hose extends from the compressor into the second compartment and has a flexible portion that may be stowed within the second compartment in a compacted configuration adjacent the recharger and its flexible wiring.

DETAILED DESCRIPTION

Figure 1:
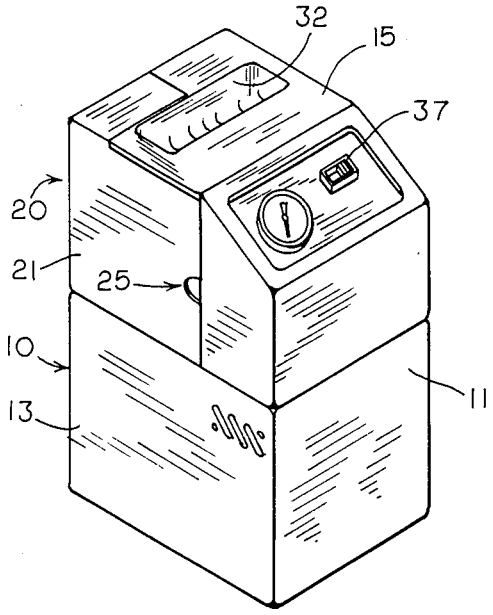
FIG. 1 is a perspective view of a portable air pump embodying principles of the invention shown with an access door closed.

With reference next to the drawing, there is shown a portable air pump having a plastic housing indicated generally at 10 which includes a front wall 11, a back wall 12, two side walls 13, a bottom wall or floor 14 and a top wall 15. One of the side walls 13 is adapted for removal to provide access to the entire interior of the housing, but such adaptation is not shown. Air vents 18 are formed in each of the two side walls 13.

Figure 2:
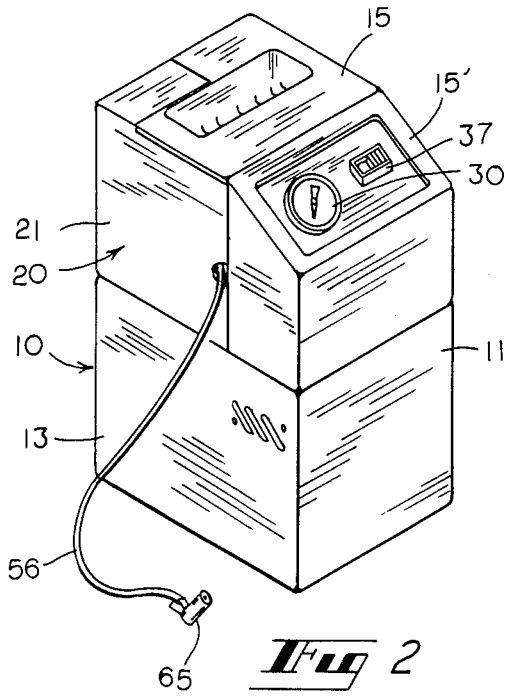
FIG. 2 is a perspective view of the same air pump shown with the access door also closed but with a flexible air hose extending out through an aperture in the door.
Figure 3:
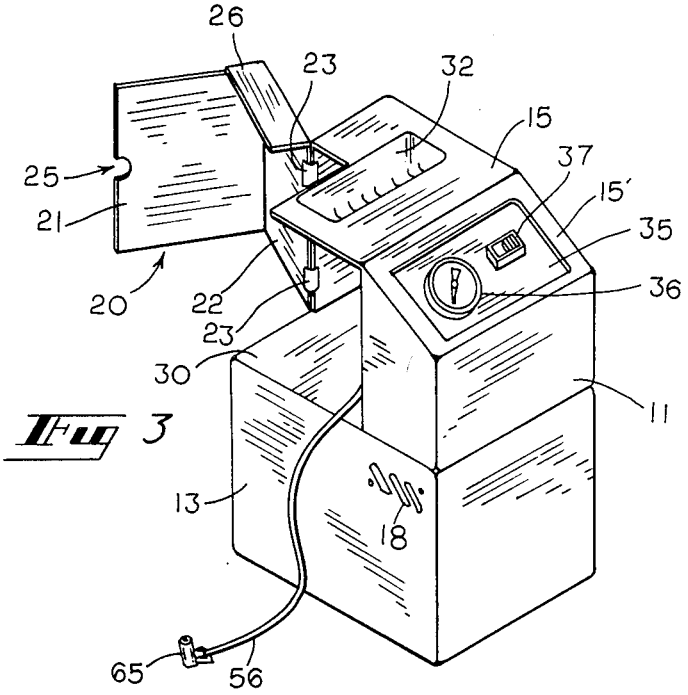
FIG. 3 is another perspective view of the same portable air pump shown with the access door in an open position and a flexible air hose extending out of a now exposed interior compartment through the doorway.

The air pump is further seen to include a door indicated generally at 20 which is shown in a closed position in FIGS. 1 and 2 and in an open position in FIG. 3. The door 20 is in the overall shape of a corner and includes a side panel 21 which extends right angularly from a rear panel 22. The rear panel 22 is pivotably mounted by hinges 23 to the housing rear wall 12. The panel 21 is formed with an indentation 25 in a side edge thereof which is of a size to provide an aperture through which a flexible hose may extend, as hereinafter described. The door also includes an upper panel 26 which extends right angularly from the upper edge of rear panel 22. The door is seen to swing from a horizontal interior wall or floor partition 30 that extends between the two side walls 13.

Figure 4:
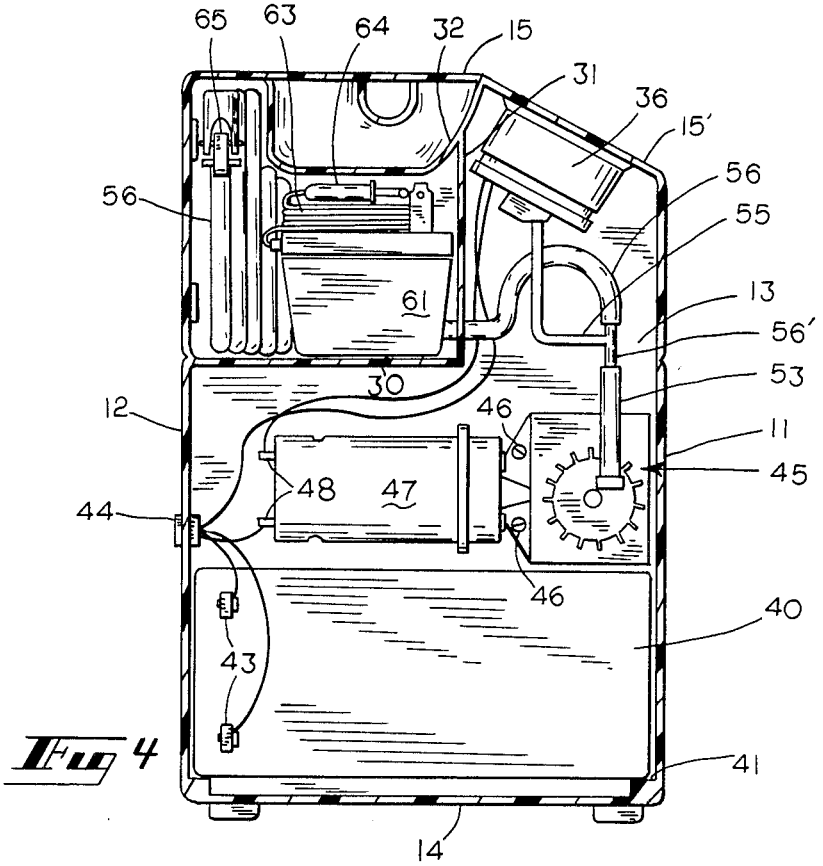
FIG. 4 is a side elevational view of the same air pump with the housing sectioned to reveal interior components of the portable air pump.

As best shown in FIG. 4, the interior floor partition 30 merges with an interior upright partition 31 that extends upwardly therefrom to a cup-shaped wall 32 that extends reentrantly downwardly from the top wall 15 to provide a hand grip. The door panel 26 is seen to swing away from and towards a position in close proximity with the rear portion of the hand grip. Finally, an intrument panel 35 is mounted on an inclined front portion 15' of the top wall. A pressure meter 36 and a manually actuatable switch 37 are mounted on this panel.

With continued reference to FIG. 4, the housing is seen to house a battery 40 which is mounted upon a ledge 41 that juts upwardly from the floor 14. Electrical wires extend from battery terminals 43 to a jack 44 mounted to rear wall 12 accessibly to ambience. An air compressor, shown generally at 45, is mounted by screws 46 to a side wall 13 of the housing above the battery 40. The air compressor includes a d.c. motor 47 having terminals 48 from which wires extend to jack 44 through switch 37 where they are joined with the battery wires so as to couple the battery across the compressor motor. An air outlet pipe 53 extends upwardly from and beside the air compressor 45. A conduit 55 communicates between the air outlet pipe 53 and the meter 30 via unitary merger with a conduit 56' that extends out of the air outlet pipe. A flexible hose 56 also extends from the conduit 56', through an aperture formed in internal partition 31, and into the compartment that is accessible to ambience via door 20. Within this accessible compartment the flexible air hose 56 is packed and confined in a serpentine configuration against the side wall 13, as illustrated in FIG. 4, along with its end nozzle and check valve 65.

Figure 5:
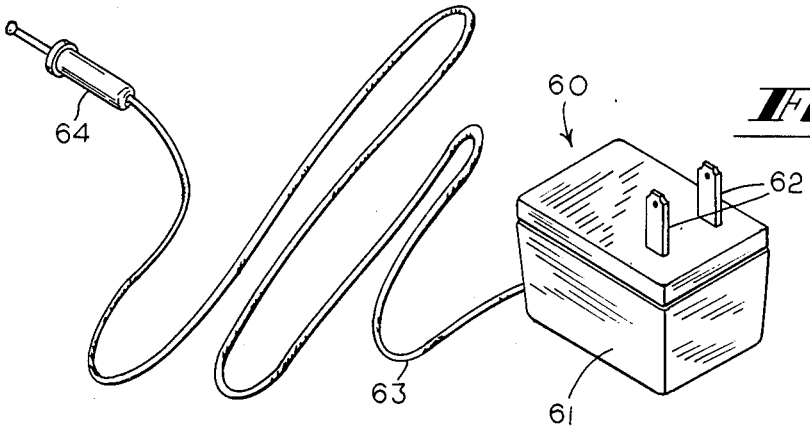
FIG. 5 is a perspective view of a battery recharger shown removed from the portable air pump which may be used to recharge its battery.

With reference to both FIGS. 4 and 5, a conventional battery recharger 60 is shown having a main body 61 from which a pair of male terminals 62 extends and from which flexible hook-up wiring 63 extends to a plug 64. In FIG. 4 the recharger is seen to be stowed upon the internal partition 30 beside the stowed, flexible air hose with its flexible electrical wiring 63 coiled atop the recharger housing body 61. In FIG. 5 the recharger is shown removed from the air pump and its wiring uncoiled.

Prior to use, the portable air pump may be configured as shown in FIG. 4 with both the flexible air hose 56 stowed and the recharger 60 stowed therein. For use, the door 20 is swung open, as shown in FIG. 3, and the flexible air hose 56 extended out of the accessible compartment as shown. If desired, the door may then be closed with the air hose continuing to extend out of the housing as shown in FIG. 2. This may be particularly desirable as where the recharger 60 is to continue to be confined within the housing rather than removed from it, as shown in FIG. 3. With the flexible air hose 56 projecting out from the housing its nozzle may be coupled with a valve stem of a tire for inflation upon manual actuation of switch 37. As air is expended air pressure is maintained by operation of the air compressor as it is powered by the battery 40. The pressure reading may be readily observed upon the meter 36. After a desired pressure has been obtained the nozzle 65 is decoupled from the tire valve stem and stored away by reopening the access door 20 temporarily.

In the event the battery 40 should need recharging, the recharger 60 may be removed from the accessible compartment within the housing and its plug 64 inserted into the jack 44. Upon coupling the recharger male terminals 62 with a source of a.c. power, as by inserting the terminals 62 into a conventional a.c. wall socket, the battery may be recharged. While it is normally desirable to retain the recharger within the exteriorally accessible compartment, such is not required.

It thus is seen that a portable air pump is provided which overcomes problems associated with the air pumps of the prior art. Many modifications, additions and deletions may, of course, be made thereto without departure from the spirit and scope of the invention as set forth in the following claims.

I claim:

1. A portable air pump comprising a housing that has a bottom wall fixedly conjoined by side walls to a top wall which has an opening formed therein from which a cup-shaped wall extends reentrantly downwardly to provide a hand grip; an internal wall at least partially located between said housing bottom wall and said cup-shaped wall that partitions first and second internal compartments within said housing; a battery mounted within said first compartment adjacent said bottom wall and electrically coupled with a jack mounted on said housing; an air compressor mounted within said first compartment above said battery and electrically coupled with said battery through switch means mounted on said housing accessible to ambience; vent means for permitting air ingress from ambience into said first compartment; a battery recharger stowable within said second compartment that has flexible electrical wiring which terminates with a plug adapted for releasible connection with said jack; an air hose extending from said air compressor within said first compartment into said second compartment that has a limber hose portion of a size stowable in a compacted configuration within said second compartment along with said battery recharger; and door means for providing access from ambience into the interior of said second compartment for extending the air hose to and from ambience and for removing and stowing the recharger.

2. The portable air pump of claim 1 wherein said door means has an opening therein through which said air hose flexible portion may extend with the door means in a closed position.

* * * * *